US007261810B2

(12) United States Patent
Argo et al.

(10) Patent No.: US 7,261,810 B2
(45) Date of Patent: Aug. 28, 2007

(54) METHOD AND SYSTEM FOR TRANSPORTING FLOWS OF FLUID HYDROCARBONS CONTAINING WAX, ASPHALTENES, AND/OR OTHER PRECIPITATING SOLIDS

(75) Inventors: Carl B. Argo, Surrey (GB); Phaneendra Bollavaram, Houston, TX (US); Kai W. Hjarbo, Ranheim (NO); Taras Yurievich Makogon, Houston, TX (US); Nita Oza, Houston, TX (US); Marita Wolden, Trondheim (NO); Are Lund, Trondheim (NO); Roar Larsen, Ranheim (NO)

(73) Assignees: Sinvent AS, Trondheim (NO); BP Exploration Operating Company Limited, Middlesex (GB); BP America, Warrenville, IL (US)

( * ) Notice: Subject to any disclaimer, the term of this patent is extended or adjusted under 35 U.S.C. 154(b) by 383 days.

(21) Appl. No.: 10/703,532

(22) Filed: Nov. 10, 2003

(65) Prior Publication Data

US 2004/0129609 A1 Jul. 8, 2004

(30) Foreign Application Priority Data

Nov. 12, 2002 (NO) ..... 20025420

(51) Int. Cl.
*C10G 31/06* (2006.01)

(52) U.S. Cl. ..... 208/370; 208/177; 208/309; 585/812; 585/899; 210/737

(58) Field of Classification Search ..... 208/177, 208/309, 370; 210/737; 585/812, 899
See application file for complete search history.

(56) References Cited

U.S. PATENT DOCUMENTS

| | | | | |
|---|---|---|---|---|
| 3,910,299 | A | 10/1975 | Tackett | |
| RE30,281 | E | 5/1980 | Tackett et al. | |
| 4,915,819 | A * | 4/1990 | Chirinos et al. | 208/309 |
| 6,656,366 | B1 * | 12/2003 | Fung et al. | 210/737 |
| 2002/0193644 | A1 | 12/2002 | Feustel | |

FOREIGN PATENT DOCUMENTS

| | | | |
|---|---|---|---|
| CA | 1289497 | | 9/1991 |
| WO | WO 00/25062 | * | 5/2000 |

* cited by examiner

*Primary Examiner*—Glenn Caldarola
*Assistant Examiner*—Prem C. Singh
(74) *Attorney, Agent, or Firm*—Wenderoth, Lind & Ponack, L.L.P.

(57) ABSTRACT

A method and a system for transporting a flow of fluid hydrocarbons containing wax and/or asphaltenes or any other precipitating solids through a treatment and transportation system including a pipeline are disclosed. The flow of fluid hydrocarbons is introduced into a reactor (4), where it is mixed with another fluid flow having a temperature below a crystallization temperature for the wax and/or asphaltenes or other solids and containing particles or crystals acting as nucleating and/or growth cores for the wax and/or asphaltenes or other solids, the mixing temperature providing precipitation of the wax and/or asphaltenes or other solids from the flow of fluid hydrocarbons, and the effluent flow of hydrocarbons and particles is conveyed from the reactor (4) to a pipeline (6) for transportation.

19 Claims, 2 Drawing Sheets

METHOD AND SYSTEM FOR TRANSPORTING FLOWS OF FLUID HYDROCARBONS CONTAINING WAX, ASPHALTENES, AND/OR OTHER PRECIPITATING SOLIDS

INTRODUCTION

The present invention relates to a method and system for reducing undesired deposition of matter in pipelines when transporting cold flows of liquid hydrocarbons containing in particular wax and/or asphaltenes. The concept may, however, also be applicable with regard to many other components contained in oil, gas or formation water and forming solids or deposits under temperature reduction, like but not restricted to; gas hydrates, resins, naphthenates, metal naphthenates, aliphatic aromates, fullerenes, any salts (scale) from formation water, or from any combinations hereof or with wax and asphaltenes. Such components will some times be referred to as "precipitors" in the following text. The inventive concept may also be applicable to reduction of corrosion problems in pipes or processing equipment by binding free water in e.g. gas hydrates. In the method and system of the invention, said flows are transported through a treatment and transportation system including a pipeline.

BACKGROUND

The current direction of the oil and gas industry is to develop new offshore fields with multiple subsea tiebacks to host hubs, field centres or onshore facilities for final processing. This is often based on the requirement to make more effective use of existing infrastructure. One of the present key project stoppers for long distance tiebacks is incomplete and very expensive technology for avoiding problems with phase changes in the fluids, and possible deposition in pipelines. Cold flow, with slurry transport of solidified components, is an attractive solution, but it entails substantial challenges due to the phenomena associated with low-temperature fluid flow. Cold flow solutions may also be of high importance for many onshore field developments, as well as for long-distance transport of fully or partly processed liquid hydrocarbons.

Multiphase hydrocarbon wellstream transport exceeding the present-day transfer distances is of strategic importance for future deepwater field developments as well as being an enabler for economical exploitation of many marginal satellite fields and prospects at moderate water depths. Current technology for avoiding problems with e.g. wax or asphaltene deposition, or other solids, often entails adding significant amounts of inhibiting chemicals. This has a great impact on system economy, and is often also detrimental to local and/or global environmental aspects. Alternatively, pipelines for hydrocarbon transport may have to be thoroughly insulated or actively heated (both options are prohibitively expensive), regular scraping operations (pigging) may have to be conducted, or a large amount of fluid processing will have to take place close to the place of production, entailing e.g. complex offshore platform systems or large process facilities for onshore situations.

One challenging problem for cold flow is the presence of paraffinic wax and/or asphaltenes and/or other precipitating solids (i.e. "precipitors") in many oil or condensate systems. When warm oil or condensate from e.g. a reservoir or from any other source of warm hydrocarbons is cooled down and/or the pressure is reduced, precipitors in the oil or condensate may become supersaturated and precipitate out as deposits on for example a pipe wall, or as solid particles/crystals suspended in the oil or condensate fluid. In some situations they may form a gel in the oil or condensate phase. Deposits of precipitors in pipelines can reduce production (by e.g. blocking conduits completely), reduce system regularity, and may increase costs through lost revenue and workovers by e.g. regular pigging of the pipeline.

When precipitors precipitate in an oil or condensate phase as small crystals or particles, they may be carried along with the hydrocarbon fluid without causing deposits or plugging. This is usually promoted by adding chemicals to the oil or condensate fluid before it is cooled to the crystallization temperature of the precipitors, or by mechanically dislodging deposits from surfaces after formation. From laboratory experiments, it is also well known that an increased supersaturation promotes crystallization of smaller precipitor particles inside the bulk of the oil or condensate phase.

U.S. Pat. No. 3,846,279 describes a method for producing wax slurries by using a fractionation tower and a water-filled reactor to produce wax particle slurries which can transport up to about 50% by weight of wax solids in the carrying oil. U.S. Pat. No. 3,910,299 makes use of essentially the same procedure, but with jacket circulation cooling instead of a water bath. A claimed wax fraction of up to 80% by weight is supposed to be transportable as a slurry after the process. Both these patents depend on a fractionation column being present upstream of the wax particle production equipment. U.S. Pat. Nos. 4,697,426 and 4,702,758 use shock cooling by choke expansion of gas or expansion turbines, respectively, to achieve quick formation of wax crystals, which are said to be transportable as a slurry thereafter. In U.S. Pat. No. 6,070,417 a process is described in which a fluid which may form solid deposits is circulated through a heat exchanger where large temperature gradients at the exchanger walls provide a tendency for solids formation to take place there. A runner designed to continuously circulate around in the heat exchanger, dislodges the solid depositions, ensuring that they are carried away into e.g. a pipeline at the outflow end of the heat exchanger. The same principle is explicitly proposed for wax deposition by Amin et al. (SPE paper 62947, ATCE Dallas, Tex., 1-4 Oct. 2000, 9 pp).

In Canadian patent no. 1,289,497, a method is given where a small amount of a cooled oil or condensate containing a large number of small wax particles or crystals suspended therein is added to a waxy oil or condensate at a temperature above the crystallization point of wax. Due to a higher melting point of formed wax the suspended wax particles will act as nuclei or centers of wax precipitation as the oil or condensate is thereafter cooled slowly below the crystallization point of wax. The cooled oil containing small wax particles or crystals may be obtained by withdrawing and cooling a small portion of the warm waxy oil or condensate before it is recycled into the warm waxy oil or condensate. To control wax formation by controlling the rate or degree of cooling of the main oil or condensate fluid is in Canadian patent no. 1,289,497 stated to be impractical or uneconomic.

British patent no. GB 2,358,640 described a method and system for transporting a flow of fluid hydrocarbons containing water, at elevated pressure. In the method, a flow of fluid hydrocarbons containing water at a temperature above the hydrate crystallization temperature is mixed with a cooled flow of fluid hydrocarbons containing gas hydrate particles. At the mixing point, the water from the warm fluid flow will moisten the dry hydrate particles from the cooled fluid flow. The temperature in the fluid flow after the mixing point is below the crystallization temperature of gas hydrates. The water-moistened dry hydrate particles in the fluid flow will—due to the supersaturation—quickly convert to dry hydrate without forming hydrate deposits on e.g. the pipe wall. The cooled fluid flow containing dry hydrate particles is obtained by recycling a sufficient part of the cooled mixed fluid flow. The amount of cooled fluid to be recycled is determined by the cooling required in order to obtain a mixing temperature close to the hydrate crystallization temperature.

SUMMARY OF THE INVENTION

In a first aspect the invention provides a method for transporting a flow of fluid hydrocarbons containing any of wax, asphaltenes, other precipitating solids and combinations thereof (precipitors), through a treatment and transportation system including a pipeline, characterized in introducing the flow of fluid hydrocarbons into a reactor, where it is mixed with a first fluid flow having a temperature below a crystallization temperature for precipitors and containing particles or crystals acting as nucleating and/or growth cores for said precipitors, the first fluid flow providing sub-cooling of the hydrocarbon flow providing precipitation of the precipitors from the flow of fluid hydrocarbons, and conveying the effluent flow of hydrocarbons from the reactor to a pipeline for transportation.

In one embodiment, a fluid flow from an upstream process is used as the first fluid flow. The first fluid flow may be oil or condensate.

In another embodiment, the extent of sub-cooling is controlled by the amount of first fluid flow. Alternatively, the extent of subcooling may be controlled by means of a heat exchanger inserted between a hydrocarbon source and the reactor. Further, the effluent flow of hydrocarbons from the reactor may be cooled in a heat exchanger to complete precipitation of the precipitors.

In another embodiment of the first aspect of the invention, deposition is controlled by partly insulating or actively heating the reactor and any subsequent heat exchanger.

The abovementioned other precipitating solids may be any of gas hydrates, resins, naphthenates, metal naphthenates, aliphatic aromates, fullerenes, and salts (scale) from formation water.

Chemicals can be added into the reactor, the chemicals being at least one of: nucleating agents for wax, asphaltene, hydrate, scale and other precipitating solids, emulsion-breakers or emulsion-formers, corrosion inhibitors or any type of chemical needed in transportation or storage of said hydrocarbon flow. The chemicals are preferably added only at start-up.

The method in accordance with the first invention aspect would be performed at the sea bottom or onshore in a cool climate, or under ambient temperature conditions sufficient to give solid deposition problems in the flow system. Further, in one embodiment, an uninsulated pipe (bare steel pipe) is used as heat exchanger when the surrounding temperature is sufficiently low.

In a second aspect, the invention provides a system for treatment and transportation of a flow of fluid hydrocarbons containing any of wax, asphaltenes, other precipitating solid and combinations thereof (precipitors), characterized in that the system comprises: a reactor connected to a hydrocarbon source to receive said flow, and to an adding means for adding a first fluid flow containing particles or crystals and having a temperature below a crystallization temperature for the precipitors into the reactor, and a pipeline for transporting the flow further on from the reactor.

The system may also include a second adding means for adding chemicals into the reactor. Further, a heat exchanger can be inserted between the hydrocarbon source and the reactor for controlling the extent of subcooling. A heat exchanger can also be inserted between the reactor and the pipeline. The inside of the reactor and heat exchanger should preferably be coated with a precipitor-repellent or general deposition-repellent material.

It is also possible to insert a separator between the heat exchanger and the pipeline, and a line leading from the separator to the reactor, the line being provided with a pump adapted to recycle some of the flow from the separator back to the reactor, to act as said first fluid flow. At least one cooler may be included in the line in series with the pump. Preferably, the at least one cooler is a bare steel uninsulated pipe.

In a preferred embodiment, the reactor and any subsequent heat exchanger are partly insulated or actively heated to control deposition.

In the method, wax and/or asphaltenes and/or other precipitating solids (i.e. "precipitors") are precipitated as small crystals or particles in an oil or condensate containing such precipitors, when a warm fluid flow of oil or condensate containing such non-solidified precipitors is mixed with a cooled fluid flow of oil or condensate containing small wax or asphaltene crystals or particles, or any other small crystals or particles. The crystals or particles in the cooled fluid flow will act as nuclei or growth centers for precipitation of the precipitors in the mixed fluid flow. The temperature in the fluid flow after mixing shall be so low as to provide some degree of supersaturation for crystallization of the precipitors in question. This will increase the precipitation speed of the precipitors on particles present in the fluid flow, decrease the size of new precipitor particles or crystals formed, and prevent or minimize deposits of precipitors on e.g. a subsea pipe wall due to a decreased temperature gradient at the pipe wall. Particles other than wax and/or asphaltene crystals can have the same effect in reducing wall deposition, due to being competing surfaces for the deposition process. The cooled fluid flow of oil or condensate containing small wax or asphaltene crystals or particles, or any other small crystals or particles, may be recycled from the mixed fluid flow or may be any upstream fluid flow.

The flow of warm fluid hydrocarbons containing non-solidified wax and asphaltenes and/or other precipitating solids is introduced into a reactor where it is mixed with a cooled flow of hydrocarbons containing small wax or asphaltene crystals or particles, or any other small crystals or particles, which are also introduced into said reactor. The effluent flow of hydrocarbons from the reactor may be cooled in a heat exchanger to ambient temperature to ensure precipitation of all precipitors, before being conveyed to a pipeline to be transported to its destination, or partly recycled to said reactor. Under certain conditions, the reactor and some downstream pipeline length may be insulated or even actively heated to control the temperature gradient between the fluids and the surroundings, to minimize deposition tendencies.

The flow of warm fluid hydrocarbons, containing non-solidified precipitors, may come from one or more drilling hole well(s), or from any hydrocarbon process plant, and may be under elevated pressure. Main examples of areas of use for this concept will be subsea oil production and transport, or onshore transport under temperature conditions promoting precipitation, or transport of processed oil from a process plant to other destinations (export oil pipelines). It is sometimes, specifically at start-up or if some deposition of e.g. wax, asphaltenes or scale and/or other precipitating solids occurs—desirable to add certain chemicals to the flow upstream from the reactor.

The cooled flow of fluid hydrocarbons (i.e. the "first fluid flow"), containing small wax or asphaltene crystals or particles, or any other small crystals or particles, to the reactor may be an upstream fluid flow, or cooled recycled fluid flow from the effluent flow of hydrocarbons leaving the above-mentioned reactor.

The method is particularly applicable in those cases where transportation takes place at a relatively low temperature, both on land in a cool climate and at the sea bottom. When the surroundings are rather cool, a heat exchanger used may be an uninsulated pipe. When the surrounding temperature is sufficiently low, this will provide satisfactory cooling without the need for any further cooling medium.

A system is described for treating and transportation of a flow of hydrocarbons containing wax and/or asphaltenes and/or other precipitating solids. The system includes the following elements listed in the flow direction and connected with each other so that the hydrocarbons may pass through the entire system: connection to a hydrocarbon source, a reactor, and a pipeline. A line which is an upstream line or which leads from a splitter (separator) to the reactor, is provided with a pump adapted to recycle material from the splitter back to the reactor. The pump may be any kind of pump suited to the rates and pressures required by the specific application.

The inside of the system, in particular the inside of the reactor may be coated with a deposition repellent material. In some cases it may be advantageous to add different chemicals to the flow of hydrocarbons, in particular during start-up and when changes are made in the operation. The system accordingly may contain a means for adding chemicals to the flow. Similarly, the outside of the reactor may be wholly or partly insulated or fitted with any means of active heating, in order to control the heat transfer between the fluids and the surroundings.

The present invention removes many costly and/or environmentally unwanted aspects, by ensuring that solids are precipitated in a transportable form without significant deposition. The solid particles may settle out during shut-in periods, but will, without a driving force for agglomeration or deposition (usually temperature or concentration gradients), readily re-disperse at later start-up. Thus, the solids have been rendered unproblematic, without the use of chemicals or other "outside intervention".

The most significant gains from a human safety or environmental viewpoint are that in offshore applications, new surface-piercing structures can be eliminated through enabling direct subsea hydrocarbon production to shore, shallow water or a host platform with available capacity. This type of safer operation removes people from deepwater offshore operations. In addition, the invention is a greener solution, due to the elimination or reduction of many chemical additions. The operational advantages are first of all due to the significant reduction of blockage risks. This means that a host of injection and control systems will become unnecessary for all types of application of the present invention. Successful cold flow means a simpler, steady operation of a low-maintenance system in thermal equilibrium with its surroundings. All of the above factors also contribute towards making cold flow an economically attractive solution. In addition, it seems clear that efficient Cold Flow may be the deciding factor—a project enabler—in terms of getting distant and/or marginal satellite fields to become economically viable. So-called "tiebacks" of producing wells to existing infrastructure is at present restricted to rather short distances, and cold flow will help extend the "reach" from existing installations significantly. It is immediately obvious that leaving out extensive heating or insulation systems is a cost saver, contributing to the commercial potential and usefulness of the present invention.

BRIEF DESCRIPTION OF DRAWINGS

In the following embodiments of the present invention will be described with reference to the following drawings, where.

DETAILED DESCRIPTION

Figure 1:
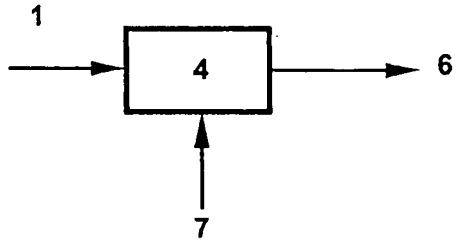
FIG. 1 is a diagram of a treatment system for precipitors according to a first embodiment of the invention.

In the drawings, the same reference numbers constitute the same elements throughout the different views.

A first embodiment of the present invention is shown in FIG. 1. Warm oil/condensate containing dissolved wax and/or asphaltenes and/or other precipitating solids (hereafter named "precipitors"), which may be at elevated pressure, arrives from a hydrocarbon source 1, to be mixed in a reactor 4 with a cold fluid flow containing small particles or crystals and coming from an adding means 7. The particles or crystals may be any of several precipitates from the hydrocarbon fluid (e.g. carbonates or other scaling compounds, salts, wax, asphaltenes, or gas hydrates), other solids from upstream processes (e.g. sand from the hydrocarbon reservoir, or rust particles from corrosion activity), or any particles added explicitly to the system to facilitate nucleation, or any particles created by the addition of chemicals to aid in their production.

In the reactor 4 the warm fluid flow will almost immediately be cooled to a temperature below the crystallization temperature of the precipitors (sub-cooled, or supersaturated). The particles and crystals in the cold fluid flow will then act as nucleation points and growth sites for precipitation of precipitors from the warm fluid flow. The extent of sub-cooling for precipitation of the precipitors in the reactor 4 is accomplished by adding sufficient cold fluid flow from the adding means 7. Undesired fouling or formation of deposits in the reactor 4 may optionally be avoided by locally coating all surfaces with a wax/asphaltene-repellent or general deposition-repellent coating. Additionally, insulation or heating of the reactor 4 may be used.

The resulting fluid flow from the reactor 4 is then fed into a pipeline 6 and transported to any process plant or storage (e.g. to an offshore platform or onshore facility for processing), or totally or partly be conveyed to a downstream application of the present invention as a cold fluid stream.

Figure 2:
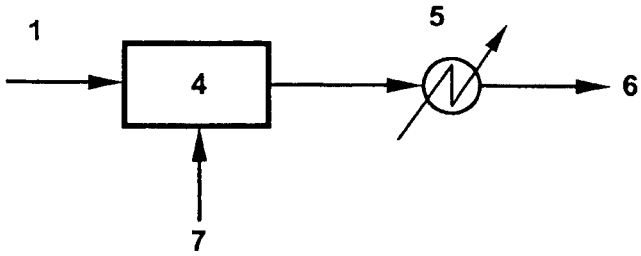
FIG. 2 is a diagram of a treatment system for precipitors according to a second embodiment of the invention.

In a second embodiment shown in FIG. 2, the fluid from the reactor 4 is cooled down to near ambient temperature in a heat exchanger 5 in order to complete precipitation of precipitors from the warm fluid flow 1 before entering the pipeline 6, if needed. The heat exchanger 5 may be an uninsulated pipe or any type of cooler, which even may be integrated as a part of the reactor 4 and/or the pipeline 6.

Figure 3:
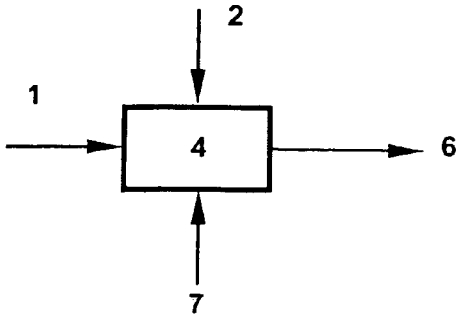
FIG. 3 is a diagram of a treatment system for precipitors according to a third embodiment of the invention.

In a third embodiment (FIG. 3), any desired chemicals are added directly to the reactor 4 by a second adding means 2. The chemicals in question may be nucleating agents for wax/asphaltenes/hydrate/scale and/or other precipitating solids, preferably only at start-up, emulsion-breakers/-formers, or any other type of chemicals eventually needed (e.g. corrosion inhibitors) in the transportation or storage of said fluid. The chemicals 2 used should be acceptable for the environment and should generally be used during first system start-up only.

Figure 4:
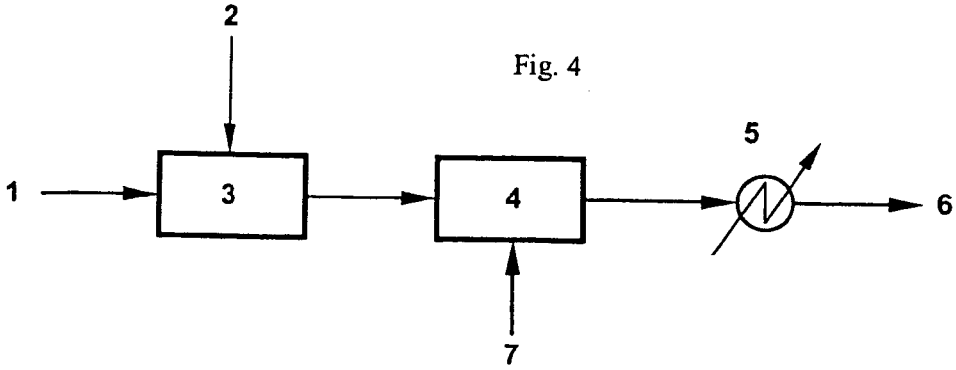
FIG. 4 is a diagram of a treatment system for precipitors according to a fourth embodiment of the invention.

In a fourth embodiment (FIG. 4), the warm source 1 oil/condensate containing dissolved precipitors and which may be at elevated pressure, is optionally mixed with any desired chemicals 2 in a mixing means 3. The chemicals in question may be nucleating agents for wax/asphaltenes/hydrate/scale and/or other precipitating solids, preferably only at start-up, emulsion-breakers/-formers, or any other type of chemicals eventually needed (e.g. corrosion inhibitors) in the transportation or storage of said fluid. The chemicals used should be acceptable for the environment and should generally be used during start-up only. Using a mixing means 3 is preferable to the third embodiment if the chemicals are mainly only to interact with the content of the warm fluid flow 1 or to simplify the construction/operation cost of the reactor 4.

The fluid flow from the mixing means 3 is conveyed into a reactor 4, where it is mixed with a cold (temperature below the crystallization temperature of the precipitors) fluid flow from an upstream process (fluid stream 6 from an upstream system of the present invention or from any other suitable upstream process). Said cold fluid is oil/condensate containing small particles or crystals. Said particles or crystals may be of wax or asphaltenes or any or more of several precipitates from the hydrocarbon fluid (e.g. carbonates or other scaling compounds, salts, or gas hydrates), other solids from upstream processes (e.g. sand from the hydrocarbon reservoir, or rust particles from corrosion activity), or any particles added explicitly to the system to facilitate nucleation, or any particles created by the addition of chemicals to aid in their production.

In the reactor 4 the warm fluid flow 1 will immediately be cooled to a temperature below the crystallization temperature of the precipitors (sub-cooled, or supersaturated). The particles and crystals in the cold fluid flow 7 will then act as nucleation points and growth sites for precipitation of precipitors from the warm fluid flow 1. The extent of sub-cooling for precipitation of the precipitors in the reactor 4 is accomplished by adding sufficient cold fluid flow 7. Undesired fouling or formation of deposits in the reactor 4 may optionally be avoided by locally coating all surfaces with a wax/asphaltene-repellent or general deposition-repellent coating. Additionally, insulation or heating of the reactor 4 may be used.

From the reactor 4 the fluid is cooled down to near ambient temperature in a heat exchanger 5 in order to complete precipitation of the precipitors from the warm fluid flow before entering the pipeline 6, if needed. The heat exchanger 5 may be an uninsulated pipe or any type of cooler, which even may be integrated as a part of the reactor 4 and/or the pipeline 6.

The fluid flow in the pipeline 6 may be transported to any process plant or storage (e.g. to an offshore platform or onshore facility for processing), over any practical distance achieved, or totally or partly be conveyed to a downstream application of the present invention as the cold fluid stream 7.

Figure 5:
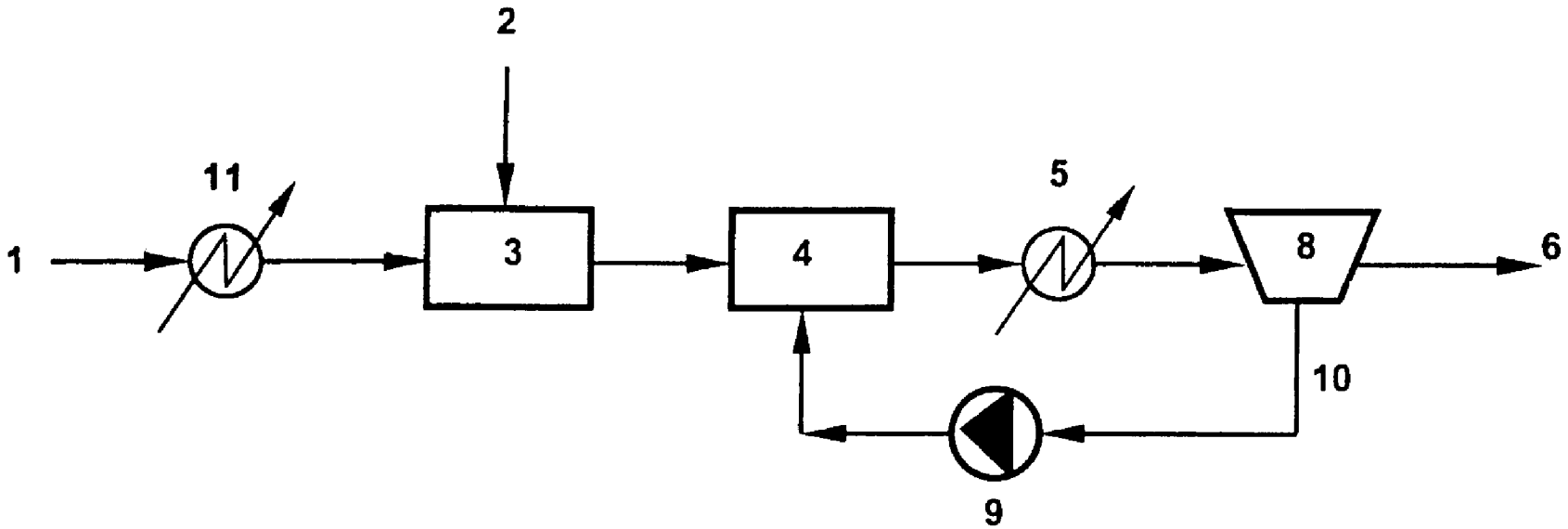
FIG. 5 is a diagram of a treatment system for precipitors according to a fifth embodiment of the invention.

In a fifth embodiment of the invention (FIG. 5), the system is used in a single application of the method or as a first application in a series of applications of the system. Warm oil/condensate containing wax/asphaltenes and/or other precipitating solids which may arrive from the source 1 at elevated pressure, is optionally pre-cooled in a heat exchanger 11, and thereafter optionally mixed with any desired chemicals 2 in a mixing means 3. The chemical mixer 3 may be excluded if chemicals are not needed in fluid flow 1 prior to reactor 4, or any desired chemicals 2 may be added directly to the reactor 4. This is the situation when any desired chemicals are not only to interact with the content of fluid flow 1.

The fluid flow from the mixing means 3 is conveyed into a reactor 4, where it is mixed with a cold (temperature below the crystallization temperature of the precipitors) fluid flow from a splitter 8. Said cold fluid contains small particles or crystals. Said particles or crystals may be any or more of several precipitates from the hydrocarbon fluid (e.g. carbonates or other scaling compounds, salts, wax, asphaltenes, or gas hydrates), other solids from upstream processes (e.g. sand from the hydrocarbon reservoir, or rust particles from corrosion activity), or any particles added explicitly to the system to facilitate nucleation, or any particles created by the addition of chemicals to aid in their production.

In the reactor 4 the warm fluid flow 1 will immediately be cooled to a temperature below the crystallization temperature of the precipitors (sub-cooled, or supersaturated). The particles and crystals in the cold fluid flow 7 will then act as nucleation points and growth sites for precipitation of precipitors from the warm fluid flow 1. The extent of sub-cooling for precipitation of precipitors in the reactor 4 is accomplished by adding sufficient cold fluid flow 7. Undesired fouling or formation of deposits in the reactor 4 may optionally be avoided by locally coating all surfaces with a wax/asphaltene-repellent or general deposition-repellent coating. Additionally, insulation or heating of the reactor 4 may be used.

From the reactor 4 the fluid may be cooled down to near ambient temperature in a heat exchanger 5 in order to complete precipitation of the precipitors from the warm fluid flow before entering the pipeline 6. The heat exchanger 5 may be an uninsulated pipe or any type of cooler, which even may be integrated as a part of the reactor 4 and/or the pipeline 6.

In the separator or flow splitter 8 a fluid flow is separated from the rest and conveyed out to a pipeline 6. At continuous operating conditions the fluid flow 6, including the content of wax and asphaltenes and/or other precipitating solids, will be equivalent to fluid flow 1.

Residual fluid from the splitter 8 is recycled through a line 10 by means of a pump 9 back to the reactor 4. The splitter 8 may be any suitable type of splitter or separator. Similarly, the pump 9 may be any suitable type of pump. One or more coolers may be included in the line 10 either before or behind the pump 9, preferably just as a bare steel, uninsulated pipe, exchanging heat with the surroundings.

The fluid flow in pipeline 6 may be transported to a process or storage plant or totally or partly be conveyed to a downstream application of the present invention as the cold fluid stream 7.

A further, general discussion of the present invention is given in the following.

The main principle of the present invention is the mixing of a hot hydrocarbon fluid containing at least wax and/or asphaltenes and/or other precipitating solids (i.e. "precipitors"), with a sufficient amount of cold fluid flow of hydrocarbon fluid containing small particles or crystals of wax, asphaltenes or any other suitable nucleation and/or growth sites. The size of the particles and crystals should be less than 5 mm diameter, preferably less than 1 mm in diameter. At the mixing point the resulting temperature should be into the supercooled region (temperature and pressure) for precipitation of precipitors. For oil or condensate systems this implies that the warm fluid flow might have a temperature from 40° C. to 200° C., preferably from 40° C. to 80° C., before being mixed with the cold fluid flow. The cold fluid usually will have a temperature at or near ambient temperature, which at a sea bottom typically will be in the region −2 to +20° C., preferably between −2° C. and +6° C., depending on water depth and geographical region. The temperature in the mixed flow should be 10K to 40K, preferably 20K to 30K below (sub-cooling) the average crystallization temperature of wax and asphaltenes in the warm fluid flow. For other precipitating solids, the subcooling or supersaturation temperatures may vary. The basic and main embodiment of the present invention is the comingling in a reactor 4 of a warm hydrocarbon stream 1 containing dissolved wax and asphaltenes and/or other precipitating solids, and a cold stream 7 with particles, to provide both sufficient cooling and seeding and/or growth sites to allow further transport in a pipeline 6. All other system parts and alternatives described in the present examples and in the text are optional, and to be used only according to specific system needs, and in any desired combination. Variations are also not restricted to the specifics mentioned herein—persons skilled in this art will readily appreciate that various additional changes and modifications can be made without departing from the spirit of the invention as defined by the claims.

A heat exchanger 5 may be defined after the reactor 4 for cooling of the effluent fluid flow before it is transported in a pipe 6 to a process or storage plant. This heat exchanger will normally be defined as a part of pipe 6, which again normally will consist of a bare steel pipe at e.g. the sea bottom. The purpose of the heat exchanger is mainly to identify places where wax and/or asphaltenes and/or other precipitating solids may deposit due to temperature decrease in the effluent fluid flow. If deposits are expected here, protective methods such as coating all surfaces in the heat exchanger with a deposit-repellant coating, or insulating the heat exchanger, may be carried out in advance, or any treatment methods as e.g. pigging facilities or heating may be installed.

If a part of the effluent fluid flow from reactor 4 is to be cooled and returned to the reactor 4 as the cold fluid flow 7, cooling may be carried out in a heat exchanger 5, before the splitter 8, or totally or partly in a heat exchanger in line 10. A heat exchanger in line 10 may be situated between the splitter 8 and pump 9 or between the pump 9 and the reactor 4 or as an integrated part of splitter 8, pump 9 or reactor 4. Preferably this heat exchanger will be a part of line 10 and consist of a bare steel pipe.

Under elevated pressure the present invention may be used in combination with the technology for treatment and transporting fluid hydrocarbons containing water as described in the patent GB 2,358,640, if water is present in the warm fluid flow 1. In the patent GB 2,358,640 the main method is conversion of free water in a warm fluid to hydrate particles by moistening of dry hydrate particles in a cold fluid flow. After moistening of the hydrate particles, the free water is converted to hydrates at subcooling. This temperature (usually below 20° C.), is usually far below the average needed temperature for precipitation (30-60° C.) of wax or asphaltenes, and will require additional amounts of the cold fluid compared to the present invention. In the present invention, the inventive method consists in nucleation and/or growth of wax and/or asphaltenes on any suitable particles or nucleation points in the cold fluid flow, together with cooling.

The splitter 8 can be any type of separation mechanism that will allow for a preferential separation of the largest solids particles, as these should preferably be routed to the flow in the pipeline 6 to avoid continuous buildup of the particle sizes. Such a separator can be, but is not limited to, a simple cyclone (flow-swirler) where the largest solids will migrate to the outside of the flowpath and may be taken out, or a gravity-separator where differences in buoyancy between different-size particles may be exploited. Any segregation effects due to particle size related to the flow conditions may also be used to achieve this split or separation (e.g. if large particles have a tendency to settle out under comparatively calm flow conditions (which may be achieved e.g. by having a certain pipe length with a larger diameter than the rest of the flow conduit)).

The present invention does not identify a preferred method of handling the resulting slurry of hydrocarbon fluids and particles/crystals when it arrives at a processing stage. It may then often be preferable to remove the particles from the slurry. This may be achieved with similar techniques as described herein for the splitter 8, or in different ways. It may e.g. in some cases be advantageous to heat the fluids to re-dissolve the solid wax and/or asphaltenes and/or other precipitating solids, or it may be done by e.g. sieving the fluids, e.g. while they reside in a separator. Or it may be better to let the solids settle out (or rise to the surface) during a storage or separator step, and then collect them mechanically from the bottom, or skim them from the top of the bulk of the fluids. Implementing the present invention will usually simplify the processing at an end stage, as the handling of the solid particles will often be easier to implement and may be more economically carried out than any mechanism or system implemented to avoid precipitation of these solids in the processing equipment.

The present invention will be further illustrated in the following, through examples which will demonstrate the usefulness and operability of the invention. These examples are provided for purposes of illustration only, and are not intended to be limiting the present invention.

EXAMPLE I

In two separate experiments, a crude oil from an offshore production field was circulated in a 50 m long 1" inner diameter high-pressure steel flow loop in a temperature-controlled environment.

The flow loop was loaded with an initial volume of about 30 liters of oil which had been cooled quickly in a separate apparatus, to allow formation of initial wax crystals in the bulk phase. When the fluids were transferred, only the free-flowing bulk phase with suspended wax crystals was filled in the loop, and gel or deposits were excluded, thus giving very good initial flowing conditions. The apparent viscosity of the oil phase was estimated to be about 35 cP.

With the original loading circulating in the loop, at an average rate of approximately 25 liters/minute, injection of fresh oil with all its wax content dissolved in non-crystalline form was started. The injection oil was pre-heated to more than 80° C. for at least 24 hours before being pumped into the circulating cold oil in the flow loop. The hot oil temperature just before injection was about 60° C. The hot oil was allowed to mix with the cold fluids, and injections were carried out in batches of about 1 kg, with time to allow for the temperature to go back to the original value of about 4° C. between most batches. The flow rate of the cold fluids was adjusted to give a ratio of cold oil to hot oil in the interval of 0.8:1 to 1.6:1 over the course of the experiments. Withdrawal of cold fluids from a separator section was performed simultaneously with the injections, to keep the pressure reasonably constant at about 80 barg. Extra injections of propane and methane were also performed in batches to better approximate realistic industry conditions for the oil. In total, 264 and 268 liters of hot oil, were injected during the two experiments.

The flow rate at a given pump power varied during the experiments, giving an indication of the wax slurry properties. There was a transition period in which the concentration of wax particles in the flow was apparently not high enough to act as nucleators for all the incoming wax content. The flow rate was lowered during this period. Steady new formation of very small wax crystals still went on in the bulk, and eventually the concentration reached a high enough value so that there were enough wax nucleators in the bulk to serve as seeds for all the incoming wax. This slurry suspension of very small crystals was flowing easily, and the high flow rate was regained fairly quickly. The mechanisms described here were supported by the study of withdrawn fluid samples in a microscope at regular intervals. The final flow rate after all injection had taken place, and all wax had crystallized, was only slightly lower than the initial rate, indicating an apparent viscosity of about 45 cP.

After the experiments were finished, the insides of the flow loop were scraped by pulling tight-fitting rubber discs through to remove and collect any wax which had deposited on the walls. In both experiments, about 1.5 g of wax were found to have deposited in the 4.8 m long downstream section from the injection point, where most of the wax crystallization processes were believed to take place. This amounts to about 0.1 wt % of the total wax content of all the oil which had been recirculated and injected.

COMPARATIVE EXAMPLE Ia

A similar experiment to those described in Example I was carried out in order to have a comparison. The major difference was that 30 liters of oil were filled into the loop at a temperature where wax crystallization still had not taken place (at about 53° C.), and then subsequently cooled through the wax fall-out temperature region while circulating in the loop. The main factors contributing to the present invention, shock cooling by mixing with a cold oil, and seeding of the crystallization by the same mixing, were not present in this experiment.

Scraping out the deposits after this test revealed about 1 g of wax in the same section which was studied in Example I. Based on the amount of oil used, this amounts to a deposition 6.2 times as high as in Example I. Several factors, especially the ageing of the wax layer (it was more easily sheared off and flushed out in this comparative test), and the less severe temperature gradient at the wall (giving less deposition tendency), indicate that this is a conservative result, i.e. that the deposition in the comparative test is in reality even higher, compared to Example I.

COMPARATIVE EXAMPLE Ib

Computer simulations of wax deposition in a system similar to the real flow loop described in Example I, were made with GUTS software, version 4.4.2. The software has a multiphase wax deposition predictive module. The heat transfer and pipe geometry were modelled after the flow loop. The inlet temperature for the simulations was specified to match the various mixing ratios (and thereby resulting temperature) of the hot and cold streams used in Example I. An inlet pressure of 70 barg and a flow rate of 267 g/s were used. The simulation time was 240 hours.

With the GUTS software, the wax deposition was estimated by taking into account the temperature development in the actual experiments, relating this to the simulated deposition rates, and finally integrating it in proportion to the time the oil was flowing at that temperature.

The expected deposit, from simulation results, in one of the experiments described in Example I (without any benefit from the invention) should be about 2.4 kg of wax in the flow loop. Extrapolation from the scraped sections, indicate that the actual amount is somewhere between 16 g and 90 g. This shows a marked improvement (over simulated results), in using the present invention.

Simulation of the actual experiment described in Comparative Example Ia predicts 12 grams of wax per 50 meters, and the actual amount of wax melted off was about 14 grams per 50 meters. Thus the GUTS model and its application scheme was shown to represent the wax deposition process in a system without the present invention being applied, reasonably well.

EXAMPLE II

As one central aspect of the present invention is rapid cooling and production of an easily flowable liquid phase, the apparent viscosity of the same crude oil as used in Example I was studied. A flow loop shaped like a wheel, with a pipe length of about 6.3 m was filled with a certain amount of the oil, and heated to above 80° C. Cooling was then performed as rapidly as possible (somewhere between 40 and 50° C./hour) to 5° C. The flow loop was rotating with a peripheral velocity of 1 m/s, translating to a shear rate of about 16 $s^{-1}$. The resulting apparent viscosity—as measured by relating the torque applied to the flow loop rotational axis to keep the rotation speed constant—was between 30 cP and 40 cP.

The crude oil used in Example I was also tested in the same wheel flow loop after having been used in the experiments in Example I, and showed the same apparent viscosity.

COMPARATIVE EXAMPLE II

The crude oil which was used in Examples I and II was also subjected to an industry test to determine its viscous behaviour over a range of temperatures. The crude oil was pretreated by heating to 80° C. to allow melting of all wax particles, and loaded into a viscometer at a temperature at least 5° C. above its wax appearance temperature (WAT). At a shear rate of 12.2 $s^{-1}$, which is of the same magnitude as in Example II, and at a cooling rate of approximately 2° C./hour (which is much slower than in Example II), the viscosity of the crude oil at a temperature of 5° C. was determined to be well above 150 cP. This clearly establishes the advantageous effects of the quick cooling introduced as part of the present invention.

Having described preferred embodiments of the invention it will be apparent to those skilled in the art that other embodiments incorporating the concepts may be used. These and other examples of the invention illustrated above are intended by way of example only and the actual scope of the invention is to be determined from the following claims.

The invention claimed is:

1. Method for transporting a flow of fluid hydrocarbons containing wax and/or asphaltenes, through a treatment and transportation system including a pipeline, which comprises introducing a first fluid flow comprising said hydrocarbons into a reactor, where it is mixed with a second fluid flow having a temperature below a crystallization temperature for said wax and/or asphaltenes, and containing particles or crystals acting as nucleating and/or growth cores for said wax and/or asphaltenes, the second fluid flow providing sub-cooling of the hydrocarbon flow to 20-60° C. to cause precipitation of the wax and/or asphaltenes from the first fluid flow, and conveying the effluent flow of hydrocarbons from the reactor to a pipeline for transportation, wherein said second fluid flow is provided from a recycled fluid flow of said effluent flow.

2. Method according to claim 1, wherein the effluent flow is transported to a downstream system and mixed with a fluid from a downstream process.

3. Method according to claim 2, wherein the second fluid flow is oil or condensate.

4. Method according to claim 1, which comprises controlling the extent of sub-cooling by controlling the flow rate of the second fluid flow.

5. Method according to claim 1, wherein the extent of subcooling is controlled by means of a heat exchanger inserted before the reactor.

6. Method according to claim 1, wherein the effluent flow of hydrocarbons from the reactor is cooled in a heat exchanger to complete precipitation of said wax and/or asphaltenes.

7. Method according to claim 1, wherein precipitation is controlled by partly insulating or actively heating the reactor and any subsequent heat exchanger.

8. Method according to claim 1, which further comprises adding chemicals into the reactor, the chemicals being at least one of: nucleating agents for wax and/or asphaltenes, emulsion-breakers or emulsion-formers, corrosion inhibitors or any type of chemical needed in transportation or storage of said hydrocarbon flow.

9. Method according to claim 8, which comprises adding the chemicals only at start-up.

10. Method according to claim 1, wherein the method is performed at the sea bottom or onshore in a cool climate, or under ambient temperature conditions sufficient to give solid deposition problems in the flow system.

11. Method according to claim 1, which comprises using an uninsulated pipe (bare steel pipe) as heat exchanger when the surrounding temperature is sufficiently low.

12. Method according to claim 1 wherein said second fluid flow provides sub-cooling of the hydrocarbon flow to 30 to 60° C.

13. Method for transporting a flow of fluid hydrocarbons containing wax and/or asphaltenes, through a treatment and transportation system including a pipeline, which comprises introducing a first fluid flow comprising said hydrocarbons into a reactor, where it is mixed with a second fluid flow having a temperature below a crystallization temperature for said wax and/or asphaltenes and containing particles or crystals acting as nucleating and/or growth cores for said wax and/or asphaltenes, the second fluid flow providing sub-cooling of the hydrocarbon flow to 20-60° C. to cause precipitation of said wax and/or asphaltenes from the flow of fluid hydrocarbons, and conveying the effluent flow of hydrocarbons from the reactor to a pipeline for transportation, wherein said second fluid flow is provided from a fluid flow from an upstream system for treatment and transportation of a flow of fluid hydrocarbons.

14. Method according to claim 13, which comprises controlling the extent of sub-cooling by the amount of fluid flow from the upstream system.

15. Method according to claim 13, which comprises controlling the extent of subcooling by means of a heat exchanger inserted before the reactor.

16. Method according to claim 13, wherein the effluent flow of hydrocarbons from the reactor is cooled in a heat exchanger to complete precipitation of said wax and/or asphaltenes.

17. Method according to claim 13, wherein precipitation is controlled by partly insulating or actively heating the reactor and any subsequent heat exchanger.

18. Method according to claim 13, wherein the method is performed at the sea bottom or onshore in a cool climate, or under ambient temperature conditions sufficient to give solid deposition problems in the flow system.

19. Method according to claim 13, wherein said fluid flow provides sub-cooling of the hydrocarbon flow to 30 to 60° C.

* * * * *